US006953371B2

(12) United States Patent
Baker et al.

(10) Patent No.: US 6,953,371 B2
(45) Date of Patent: Oct. 11, 2005

(54) APPARATUS FOR ELECTRICALLY COUPLING A LINEAR CONDUCTOR TO A SURFACE CONDUCTOR AND RELATED METHOD

(75) Inventors: Craig A. Baker, Glendale, AZ (US); David M. Ellis, Chandler, AZ (US); Richard D. Hall, Chandler, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 22 days.

(21) Appl. No.: 10/425,907

(22) Filed: Apr. 29, 2003

(65) Prior Publication Data

US 2003/0203674 A1 Oct. 30, 2003

Related U.S. Application Data

(60) Provisional application No. 60/377,045, filed on Apr. 30, 2002.

(51) Int. Cl.[7] ..... H01R 13/24

(52) U.S. Cl. ..... 439/700; 439/582; 439/63

(58) Field of Search ..... 439/582, 700, 439/824, 289, 63, 881, 466, 468, 578

(56) References Cited

U.S. PATENT DOCUMENTS

| | | | | |
|---|---|---|---|---|
| 4,593,243 A | | 6/1986 | Lao et al. | 324/158 |
| 4,659,156 A | | 4/1987 | Johnescu et al. | |
| 4,892,491 A | | 1/1990 | Budano, II et al. | 439/582 |
| 5,217,391 A | | 6/1993 | Fisher, Jr. | 439/578 |
| 5,407,366 A | | 4/1995 | Briones et al. | 439/639 |
| 5,447,442 A | | 9/1995 | Swart | 439/77 |
| 5,516,303 A | | 5/1996 | Yohn et al. | 439/248 |
| 5,681,187 A | * | 10/1997 | Fukushima et al. | 439/700 |
| 5,879,198 A | | 3/1999 | Sekimori et al. | 439/700 |
| 6,036,540 A | | 3/2000 | Beloritsky | 439/582 |
| 6,758,680 B2 | * | 7/2004 | Duquerroy et al. | 439/63 |

FOREIGN PATENT DOCUMENTS

WO WO 9843323 A1 * 10/1998 ..... H01R/17/12

* cited by examiner

*Primary Examiner*—Tho D. Ta
*Assistant Examiner*—Felix O. Figueroa
(74) *Attorney, Agent, or Firm*—Joseph M. Homa

(57) ABSTRACT

An apparatus is provided for electrically coupling an end of a linear conductor to a surface conductor. The apparatus includes a housing for receiving the linear conductor end. The housing includes a channel having a channel axis that is non-collinear with respect to the linear conductor axis. The apparatus further includes a conductive member movably disposed within the channel of the housing to move along the channel axis. The conductive member has a first end electrically coupled to the linear conductor end and a second end to electrically couple the conductive member to the surface conductor. The apparatus still further includes a biasing member in mechanical communication with the conductive member to bias the conductive member in electrical contact with the surface conductor. Related methods are provided.

29 Claims, 9 Drawing Sheets

APPARATUS FOR ELECTRICALLY COUPLING A LINEAR CONDUCTOR TO A SURFACE CONDUCTOR AND RELATED METHOD

This application claims the benefit of priority under 35 U.S.C. § 119(e) of U.S. Provisional Patent Application Ser. No. 60/377,045, filed on Apr. 30, 2002.

BACKGROUND OF THE INVENTION

1. Field of the Invention

The present invention relates to apparatus and methods for electrically coupling a linear conductor, for example, such as a wire, coaxial cable, and the like, to a surface conductor, for example, such as a metalization on a printed circuit board or semiconductor chip, and the like.

2. Description of the Related Art

There are many instances in which it is necessary or desirable to electrically couple a linear conductor to a surface conductor. A linear conductor as the term is used here refers to its normal meaning in the field, preferably albeit in a broad sense, to include conductors with cross sectional geometries that extend substantially in one principal dimension, even though they may be bent, curved, etc. Examples of linear conductors would include a wire, a cable such as a coaxial cable, and the like. A surface conductor as the term is used herein also refers to its normal meaning in the field, again preferably in a broad sense, to include conductors having a planar, substantially planar, or contoured surface. Examples of surface conductors would include metalization or conductive pads on a printed circuit board or semiconductor chip, and the like.

A common example of a circumstance in which it is desirable to electrically couple a linear conductor to a surface conductor involves the coupling of a coaxial cable to a printed circuit board so that electrical signals can be communicated from the coaxial cable to a metalization on the printed circuit board, and on to a processor or similar device on the printed circuit board, and vice versa. This type of arrangement has been used, for example, in cable television ("TV") transmission systems, in which a cable TV signal is provided to a printed circuit board in a cable box. Another example would involve coupling a coaxial cable to a printed circuit board that includes a switching device to switch the conduction path of the signal on the coaxial cable.

It is desirable in such instances to obtain a secure and high quality electrical connection between the linear conductor and the surface conductor. In many instances, however, such good quality contacting is limited or precluded, for example, because of vibrational forces, impacts, thermal expansion and contraction, etc. The negative implications of such problems associated with poor connections are well known in the field, and include low signal to noise ratios, signal fading and signal strength transients, frequency or bandwidth loss, etc. These limitations often become more pronounced as the signal frequency increases.

OBJECTS OF THE INVENTION

Accordingly, an object of the present invention is to provide a device and method for electrically coupling a linear conductor to a planar conductor wherein the electrical coupling is secure, thus providing a good quality signal path.

Another object of the invention is to provide a device and method for electrically coupling a linear conductor to a planar conductor wherein the electrical coupling is consistent and reliable.

Additional objects and advantages of the invention will be set forth in the description which follows, and in part will be apparent from the description, or may be learned by practice of the invention. The objects and advantages of the invention may be realized and obtained by means of the instrumentalities and combinations pointed out in the appended claims.

SUMMARY OF THE INVENTION

To achieve the foregoing objects, and in accordance with the purposes of the invention as embodied and broadly described in this document, an apparatus is provided for electrically coupling an end of a linear conductor to a surface conductor. The linear conductor end is disposed along a linear conductor axis. The apparatus comprises a housing for receiving the linear conductor end. The housing comprises a channel having a channel axis that is non-collinear with respect to the linear conductor axis. The apparatus further comprises a conductive member movably disposed within the channel of the housing to move along the channel axis. The conductive member has a first end electrically coupled to the linear conductor end and a second end to electrically couple the conductive member to the surface conductor. The apparatus still further comprises a biasing member in mechanical communication with the conductive member to bias the conductive member in electrical contact with the surface conductor.

Preferably but optionally, the channel axis is substantially perpendicular to the linear conductor axis. The conductive member may comprise, for example, a pin, preferably having a head.

The biasing member preferably but optionally is in physical and electrical contact with the conductive member. It also is preferred that the first end of the conductive member is electrically coupled to the linear conductor end via an intermediate conductor. The biasing member accordingly to presently preferred embodiments may comprise a cantilever beam, a spring, a resilient plug, a pneumatic device, a movable membrane, a tortioning apparatus, and the like.

In accordance with another aspect of the invention, a method is provided for electrically coupling an end of a linear conductor to a surface conductor on a surface component wherein the linear conductor end is disposed along a linear conductor axis. The method comprises electrically coupling the linear conductor end to a conductive member movably disposed in a housing. The conductive member has a first end electrically coupled to the linear conductor end and a second end to electrically couple the conductive member to the surface conductor. The method further comprises biasing the conductive member in electrical contact with the surface conductor.

BRIEF DESCRIPTION OF THE DRAWINGS

The accompanying drawings, which are incorporated in and constitute a part of the specification, illustrate presently preferred embodiments and methods of the invention and, together with the general description given above and the detailed description of the preferred embodiments and methods given below, serve to explain the principles of the invention.

DETAILED DESCRIPTION OF THE PREFERRED EMBODIMENTS AND METHODS

Figure 1:
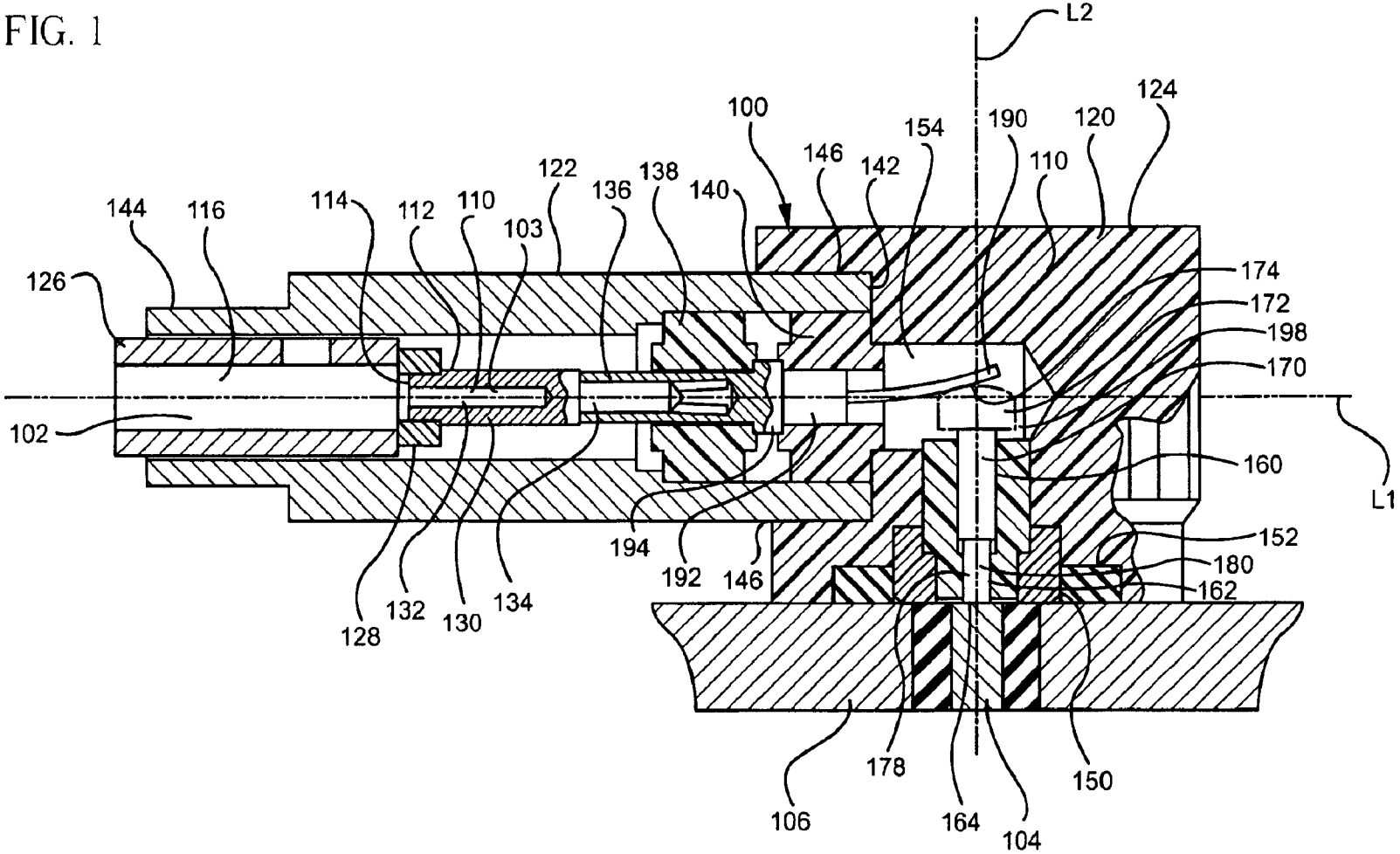
FIG. 1. is a cutaway schematic diagram of a coupling apparatus according to a first preferred embodiment of the invention.

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

In accordance with one aspect of the invention, an apparatus is provided for electrically coupling an end of a linear conductor to a surface conductor. As noted above, the linear conductor may constitute or comprise a wire, a cable, a coaxial cable, and the like. In the descriptions herein for the various aspects of the invention, the linear conductor will be assumed for simplicity and illustrative purposes to be a coaxial cable. Also for ease of reference, the linear conductor end will be assumed to be disposed along a linear conductor axis L1.

A coupling apparatus 100 according to the presently preferred embodiment of the invention is shown in FIG. 1. A Coupler 100 is for electrically coupling a linear conductor in the form of coaxial cable 102 to a surface conductor, and more specifically for coupling an end 103 of cable 102 to a surface conductor. The surface conductor in this illustrative example comprises a metalization 104 disposed on a printed circuit board 106.

Coaxial cable 102 is of known design, comprising an inner conductor 110, a "core" or insulator 112 dispose about inner conductor 110, an outer conductor 114, and an outer insulator or jacket 116. In this illustrative embodiment, coaxial cable 102 is a 50 ohm coaxial cable assumed to be communicating a signal at a main frequency of about 18 GHz. This is not, however, limiting. Couplers as generally described herein, for example, may be constructed to operate from DC (0 Hz) to frequencies ranging as high as 40 GHz or beyond. The end 103 of cable 102 is disposed about a linear conductor or cable longitudinal axis L1, which will be used herein for reference purposes.

In accordance with this aspect of the invention, the coupling apparatus comprises a housing for receiving the linear conductor end. The housing according to the presently preferred embodiments provides mechanical support for cable 102 on the surface conductor or device upon which the surface conductor resides, such as the circuit board upon which metalization 104 is disposed. The specific design and configuration of the housing may take a number of forms. Specific and presently preferred yet merely illustrative examples are provided herein and shown in the drawing figures.

Figure 2:
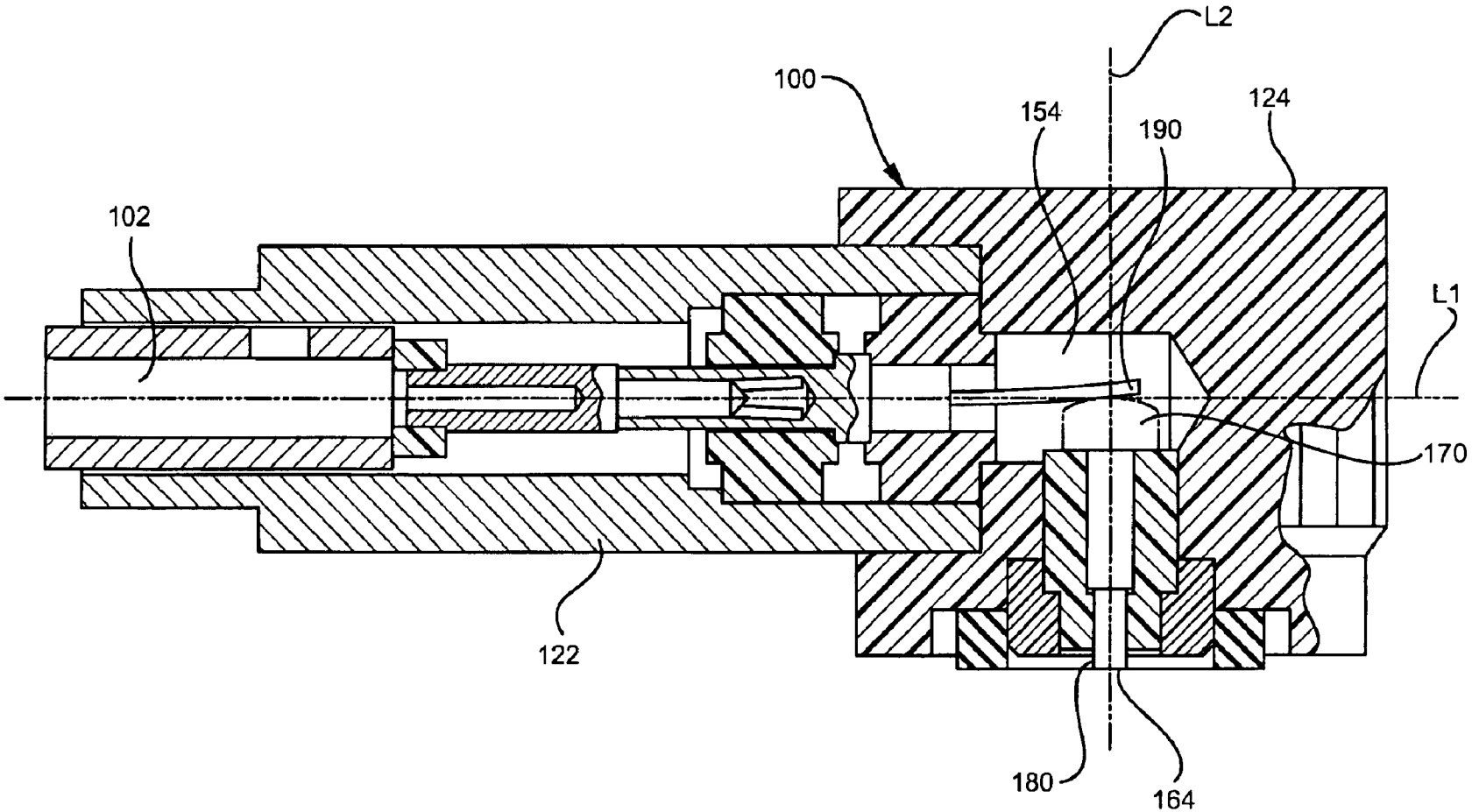
FIG. 2 shows the coupling apparatus of the FIG. 1 in a biased position.
Figure 3:
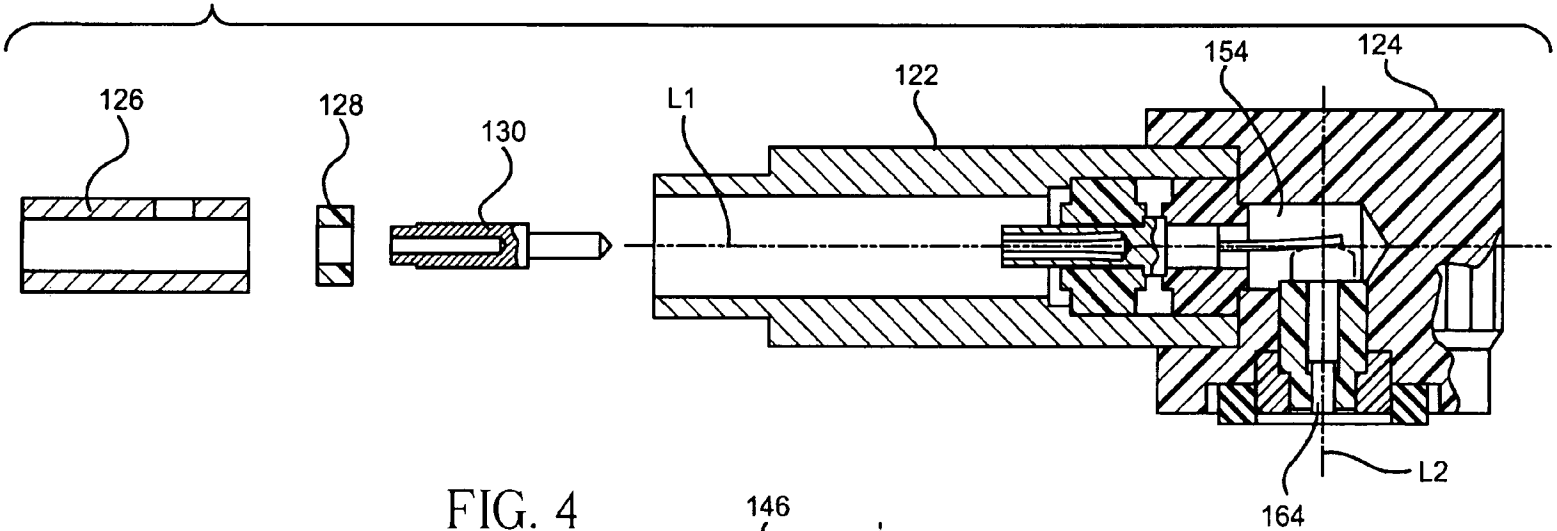
FIG. 3 shows an exploded assembly diagram for the coupling apparatus of FIG. 1.
Figure 4:
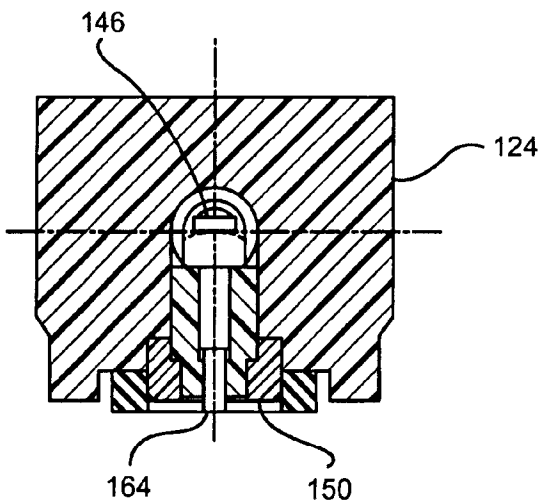
FIG. 4 shows a view of the coupling apparatus of FIG. 1 as viewed from the linear conductor axis.

With reference to FIGS. 1–3, coupler 100 comprises a housing 120 that in turn comprises a cable housing or press in housing 122 and a main housing or card launch housing 124. A solder sleeve 126 is provided to house a portion of cable 102 adjacent to its end 103, but including outer jacket 116. A dielectric stop 128 abuts solder sleeve 126. An access contact 130 provides an electrically conductive housing and extension for cable end 103. Inner conductor 110 of cable 102 is received in a cavity 132 of access contact 130, and is electrically coupled to an access pin 134. Access pin 134 is movable along longitudinal axis L1 to be inserted through an aperture 136 in a socket contact 138. A dielectric 140 is provided at an end 142 of cable housing 124 adjacent to main housing 124 and opposite cable insertion end 144 of cable housing 122. End 142 of cable housing 122 is adapted to fit into and be received in an aperture 146 in main housing 124.

Main housing 124 is adapted to be mounted to a surface, such as the surface of PC board 106. Main housing 124 in this embodiment comprises a base 150 fixedly mounted to PC board 106, and a corresponding aperture 152 for receiving base 150. A gasket may be used for vibrational isolation, sealing, etc.

A cavity 154 is disposed centrally within main housing 124. Cavity 154 is in open communication with aperture 146, which receives cable housing 122.

A cylindrical channel 160 also is disposed in main housing 124. Channel 160 is open to cavity 154, and extends from it to an aperture 162 in the base portion of main housing 124. Channel 160 extends to an aperture 164 at base 150 so that, when main housing 124 is mounted to PC board 106, aperture 164 is immediately adjacent to and/or contacts metalization 104. Channel 160 has or is disposed about a channel axis L2. When apparatus 100 is coupled to PC board 106 and cable 102 as shown, for example, in FIG. 1, it is preferred that channel axis L2 is non-collinear with respect to linear conductor axis L1. Preferably, as shown, for example, in FIG. 1–3, cable axis L1 and channel axis L2 are perpendicular to one another. This enables the footprint of the cable and PC board assembly to be small. This is not, however, necessarily limiting. The angle between axis L1 and L2 may be increased beyond 90 degrees while retaining benefits of the invention.

Optionally, the first end of the conductive member may be electrically coupled to the linear conductor end via an intermediate conductor.

Further in accordance with this aspect of the invention, the coupling apparatus comprises a conductive member movably disposed within the channel of the housing to move along the channel axis. The conductive member has a first end electrically coupled to the linear conductor end and a second end to electrically couple the conductive member to the surface conductor.

It should be noted that movement of the conductive member need not be substantial, and in many cases it will be only slight. Movement of this conductive member permits it to be urged against the surface conductor to make electrical contact with it, to improve the quality of the electrical contact or coupling with the surface conductor, etc. Although in some applications it may be desirable for the conductive member to be movable away from the surface conductor, e.g., to ohmically and capacitively decouple them or reduce such coupling, in many applications the mobility of the conductive member off of or away from the surface conductor need only be slight, e.g., to accommodate vibration, impacts, thermal expansion and contraction, and the like.

In accordance with the preferred embodiment of FIG. 1, the conductive member comprises a pin 170. Pin 170 comprises a head 172 at its first end 174. A shank 176 extends from head 172. A conductive base element 178 is integral with or rigidly coupled to shank 176. The lower portion 180 of base element 178, and thus a second end 180 of pin 170 is disposed at or adjacent to aperture, is physically separate from but is adapted to intimately contact metalization 104 of PC board 106 when pin 170 is in operation.

Further in accordance with this aspect of the invention, the coupling device comprises a biasing member in mechanical communication with the conductive member to bias the conductive member in electrical contact with the surface conductor. The biasing member optionally may be coupled to the conductive member to bias the conductive member into electrical contact with the planar conductor. The biasing member is in mechanical communication with the conductive member in that it biases or urges the conductive member into electrical contact with the surface conductor, and preferably maintains this electrical contact, within tolerable limits. There are, however, a number of different configurations that are suitable for this task. The biasing member, for example, may in a mechanical sense be integral with and/or otherwise associated with the linear conductor, it may be integral with or otherwise associated with the conductive member, it may be integral with and/or otherwise associated with the housing, or combinations of these. The biasing member thus may or may not be rigidly coupled to the conductive member. They may, for example, be separate components that merely contact one another. Conversely, they may comprise counterparts of one and the same component.

In the embodiment of FIG. 1, the biasing member comprises a cantilever beam 190. Cantilever beam 190 comprises a base 192 disposed in an aperture 194 in dielectric 140. Cantilever beam 190 in this embodiment is a heat treated Be Cu material. Cantilever beam 190 further comprises a beam 196 that is electrically coupled to access pin 134. Beam 196 extends into cavity 154 in main housing 124, and contacts the apex of head 172 of pin 172.

It should be noted that a gap 198 is formed between the side portion of pin head 172 and the adjacent wall of main housing cavity 154. In some embodiments it is desirable to adjust for the capacitance of the coupler, for example, to compensate for any changes in inductance relative to a 90 degree miter at this location. The amount of capacitive compensation will depend upon the specific application, design and operating parameters such as signal frequency, etc., and may be determined according to principles well known to those of ordinary skill in the relevant art.

Pin 170 as noted is movable within channel 160 along channel axis L2. FIG. 1 shows pin 170 in a location for which pin 170 is not seated in channel 160 to rest against and intimately contact metalization 104. In this position, beam 196 biases pin 170 so that pin 170 is urged downwardly as shown in the drawing, toward PC board 106. FIG. 2 shows pin 170 in its seated position. In this position, second end 180 of pin 170 intimately contacts metalization 104. This position is referred to herein as the operational position.

Figure 5:
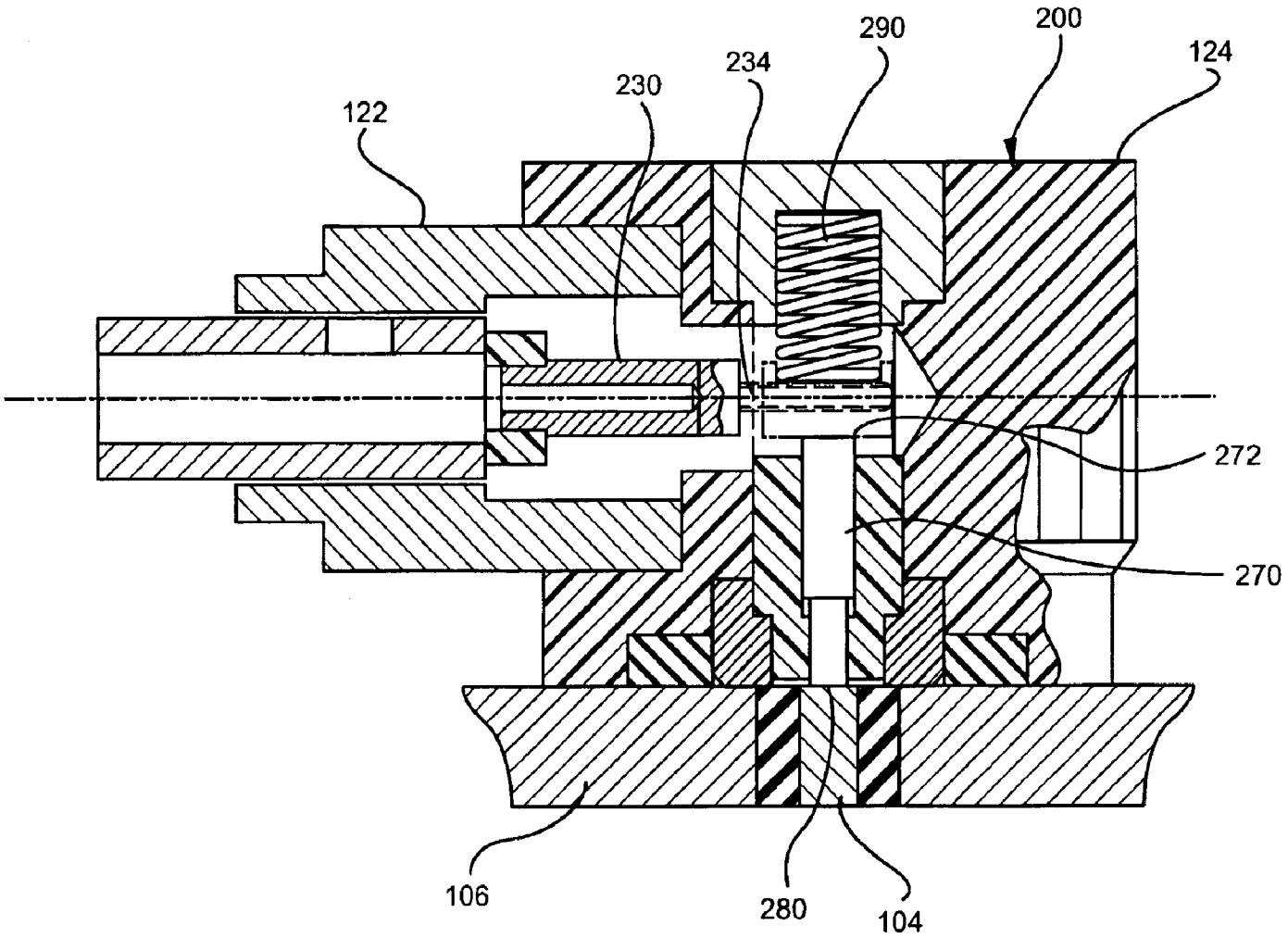
FIG. 5 shows a coupling apparatus according to a second preferred embodiment of the invention.

A coupling apparatus 200 according to a second preferred embodiment of the invention is shown in FIG. 5. Coupler 200 is identical in most respects to the design and configuration to coupler 100. They differ, however, in that cantilever beam 190 of coupler 100 has been replaced in coupler 200 with an extended access contact 230 disposed further toward main housing cavity 154 so that access pin 234 is disposed above and contacts pin head 272. Access contact 230, including access pin 234, pivot during mating of the coupler to the PC board to facilitate positioning.

Coupler 200 also differs from coupler 100 in that the biasing arrangement of coupler 100 using cantilever beam 190 has been replaced with a biasing arrangement in which the biasing member comprises a non-conductive spring 290 disposed in the upper portion of main housing cavity 154, about channel axis L2, and contacting access pin 234, so that spring 290 biases downwardly as shown in the drawing figure. Access pin 234 is urged downwardly along channel axis L2 toward metalization 104, which in turn urges pin 270 downwardly so that second end 280 of pin 270 is placed or maintained in intimate contact with metalization 104.

Figure 6:
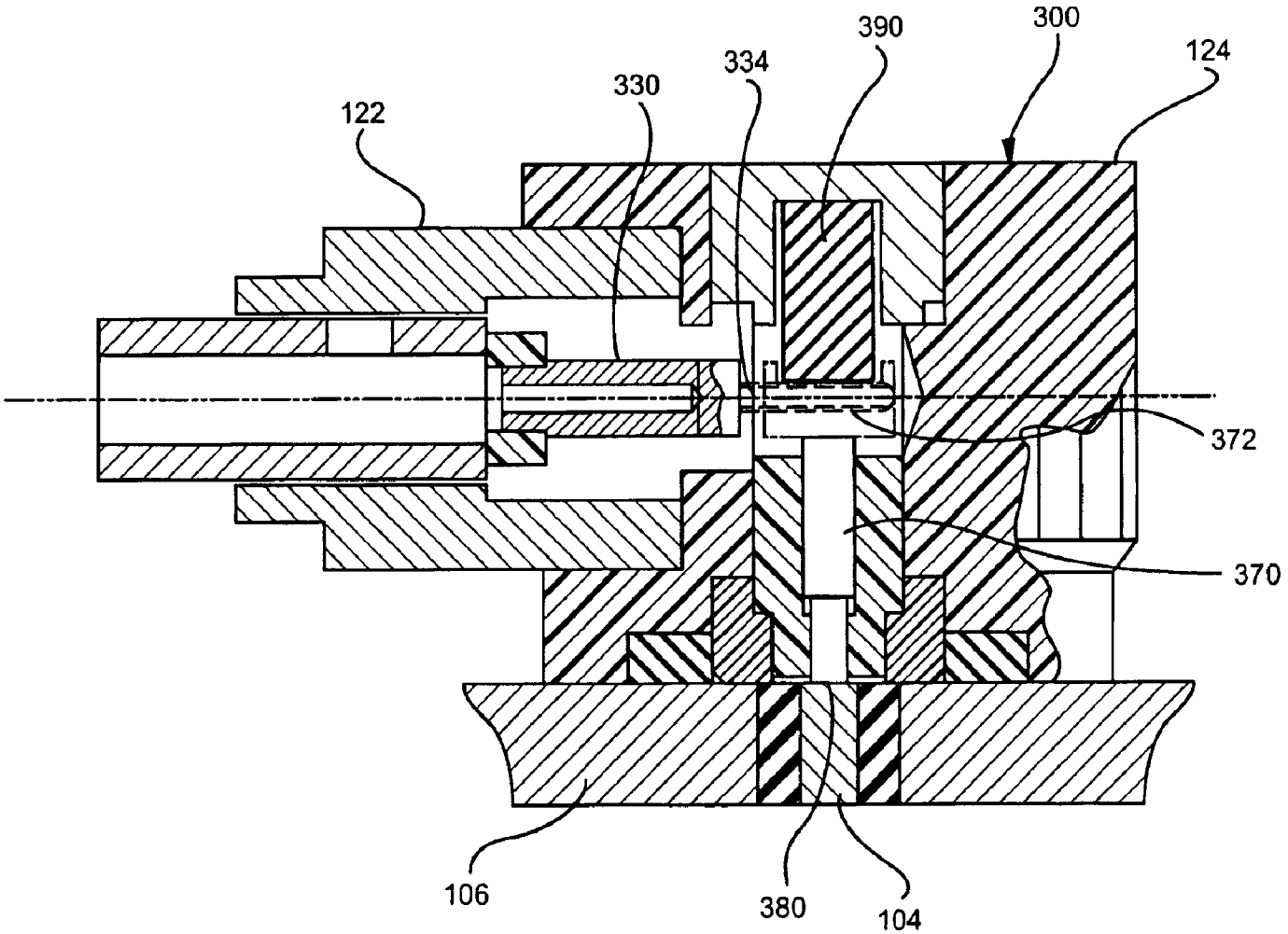
FIG. 6 shows a coupling apparatus according to a third preferred embodiment of the invention.

A coupling apparatus 300 according to a third preferred embodiment of the invention is shown in FIG. 6. Coupler 300 is identical in most respects to the design and configuration of coupler 200. They differ in that spring 290 of coupler 200 has been replaced in coupler 300 by a non-conductive compressible or otherwise resilient plug 390 in the upper portion of cavity 154, which provides a bias force to urge access pin 334, which also pivots as in access pin 234, toward metalization 104.

Figure 7:
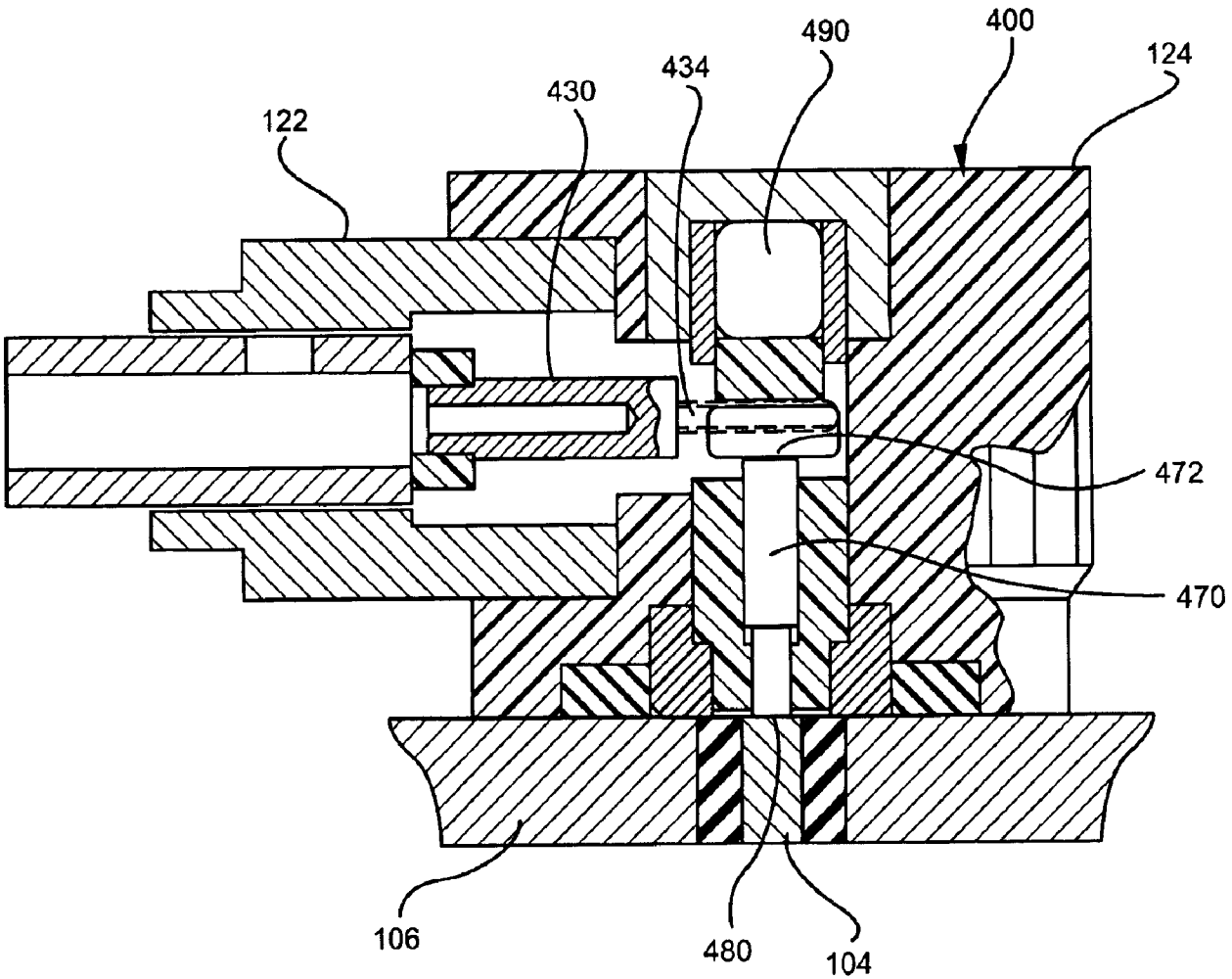
FIG. 7 shows a coupling apparatus according to a fourth preferred embodiment of the invention.

A coupling apparatus 400 according to a fourth preferred embodiment of the invention is shown in FIG. 7. Coupler 400 is identical in most respects to the design and configuration of couplers 200 and 300. They differ in that spring 290 of coupler 200 and plug 390 of coupler 300 have been replaced in coupler 400 by a pneumatic device such as a non-conductive compressible or otherwise resilient air bladder piston 490 in the upper portion of cavity 154, which provides a bias force to urge access pin 434, also a pivoting configuration as in access pin 234, toward metalization 104.

Figure 8:
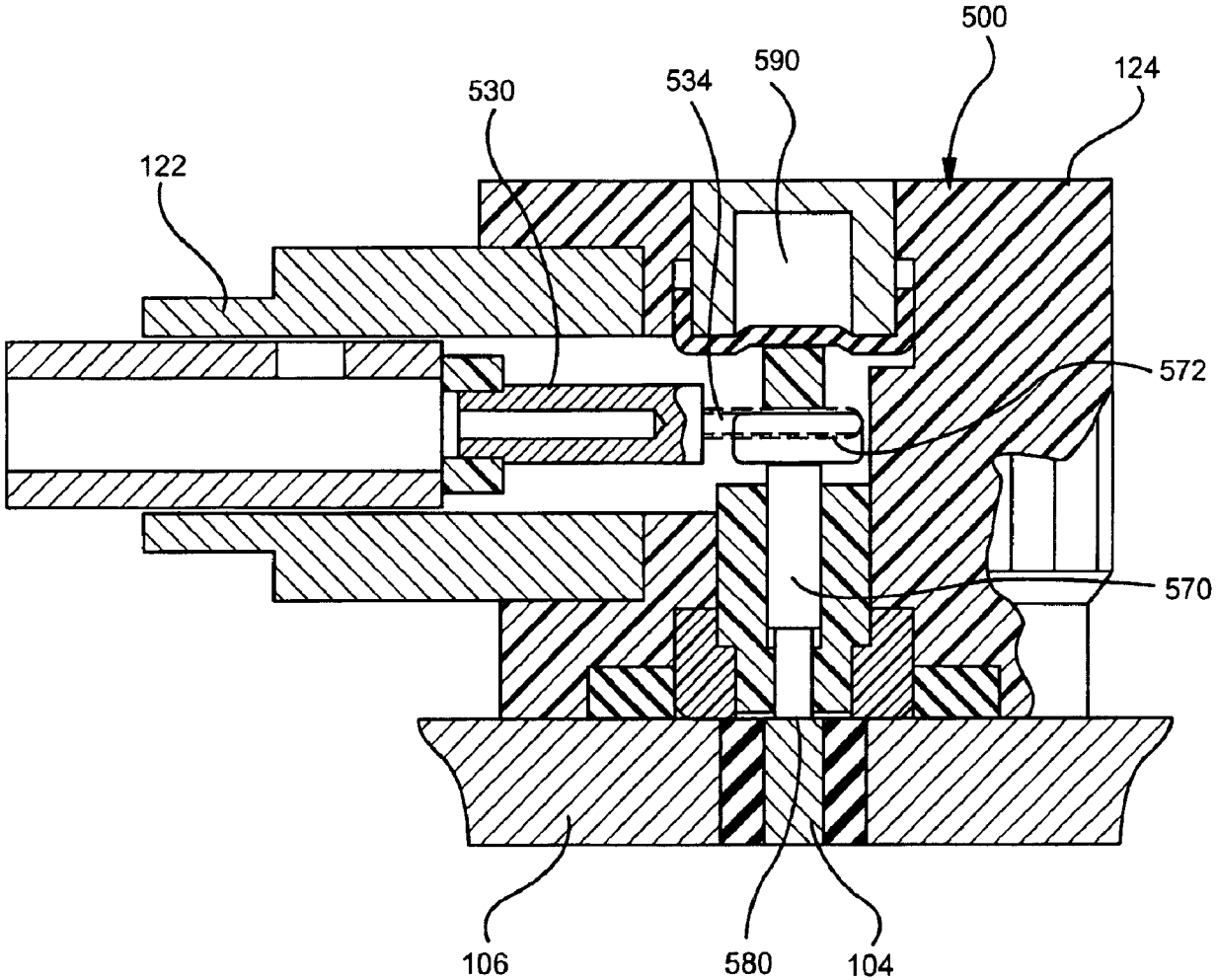
FIG. 8 shows a coupling apparatus according to a fifth preferred embodiment of the invention.

A coupling device 500 according to a fifth preferred embodiment of the invention is shown in FIG. 8. Coupler 500 is identical in most respects to the design and configuration of couplers 200, 300 and 400. They differ in that spring 290 of coupler 200, plug 390 of coupler 300 and air bladder 490 of coupler 400 have been replaced in coupler 500 by a movable membrane in the upper portion of cavity 154. Membrane 590 is movable in the sense that it is sufficiently resilient and is appropriately positioned and biased so that it provides a bias force to urge access pin 534 downwardly as shown in the figure, toward metalization 104. Membrane 590 also is movable at least in the sense that it permits movement of pin along the longitudinal axis of pin 570. Access pin 534 also pivots in this embodiment.

Figure 9:
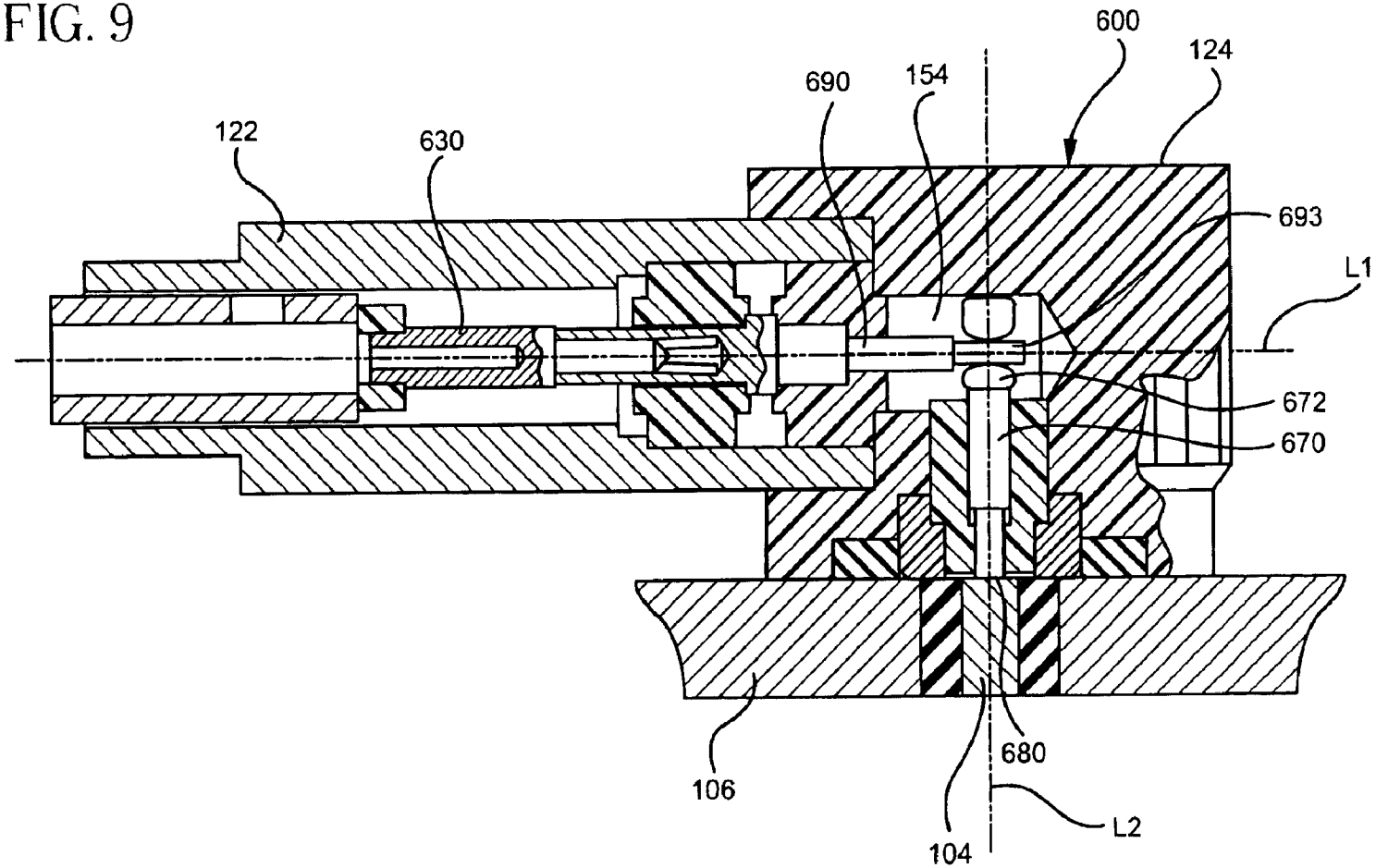
FIG. 9 shows a coupling apparatus according to a sixth preferred embodiment of the invention.
Figure 10:
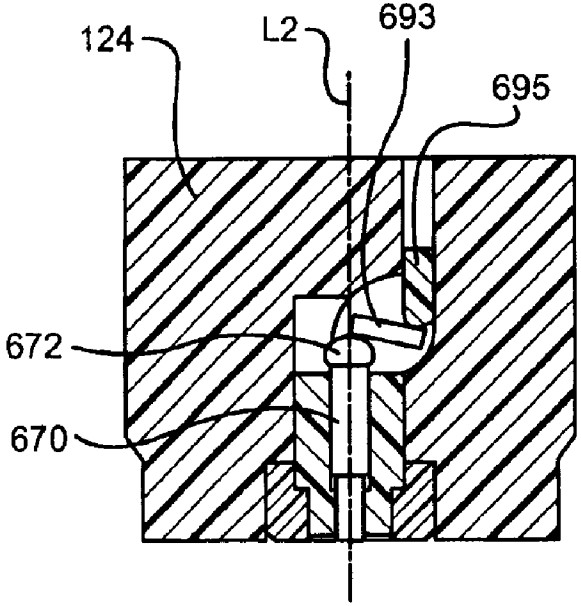
FIG. 10 shows a view of the coupling apparatus of FIG. 9 as viewed along the linear conductor axis.

A coupling apparatus 600 according to a sixth preferred embodiment of the invention is shown in FIGS. 9 and 10. This coupling apparatus is identical in most respects to coupler 100, but comprises a tortioning device 690 instead of cantilever beam 190. In coupler 600, access contact 630 and access pin 634 are rotationally mounted, so that pin 634 rotates essentially concentrically with axis L1. Tortioning device 690 comprises a rotating member 693 and a stop post 695. Rotating member 693 is coupled to the end of access pin 634, and to pin head 672. Access contact 630 is rotated when coupler 600 is assembled, so that it is tortionally biased to urge rotating member 693 tortionally, which in turn urges pin 670 downwardly as shown in the drawing, toward metalization 104.

In accordance with another aspect of the invention, a method is provided for electrically coupling an end of a linear conductor to a surface conductor wherein the linear conductor end is disposed along a linear conductor axis. This linear conductor and surface conductor may comprise any of those noted or described herein above. Presently preferred but merely illustrative implementations of the method according to this aspect of the invention will now be described. For simplicity and ease of illustration, the preferred versions of the method will be described with reference to the previously described coupling apparatus according to the presently preferred embodiments as described herein. It should be appreciated, however, that the inventive methods are not necessarily limited to these illustrative embodiments. Other hardware embodiments and configurations may be used in carrying out the inventive method.

The method according to this aspect of the invention comprises coupling the linear conductor end to a conductive member movably disposed in a housing. Optionally but preferably, the method further comprises mechanically positioning the linear conductor end at a location adjacent to the surface conductor so that the linear conductor end and the surface conductor can be electrically coupled using the conductive member. As implemented, for example, using coupling apparatus 100, the conductive member comprises pin 170. The coupling of the linear conductor end to the conductive member and the mechanical coupling of the linear conductor end adjacent to the surface conductor preferably comprise using housing 120 to mechanically couple cable end 103 of coaxial cable 102 relative to metalization 104 so that cable end 103 is adjacent to or otherwise available for electrical coupling to metalization 104 via pin 170.

The method according to this aspect of the invention also comprises biasing the conductive member in electrical contact with the surface conductor. This biasing may take a number of forms. As illustrated with respect to the presently preferred embodiments of the invention, the biasing may be accomplished using a cantilever beam to urge the conductive member into contact, or into improved contact, with the surface conductor, e.g., as shown in FIG. 1. The biasing according to this aspect of the invention also may comprise using a spring, e.g., as shown in FIG. 5, a resilient plug, e.g., as shown in FIG. 6, a pneumatic device, e.g., as shown in FIG. 7, a movable membrane, e.g., as shown in FIG. 8, a tortioning device, e.g., as shown in FIG. 9, and the like.

It should be noted that the description herein has referred to biasing the conductive member to electrically couple it to the surface conductor. This is not necessarily limiting as to the state of the apparatus when it is not in operational configuration, and thus when the conductive member is not biased toward and in intimate contact with the surface conductor. It is not necessary, for example, that the conductive member be from the surface conductor when or if the biasing device is not applying biasing force. Thus, the apparatus is not limited to situations in which the coupler is normally open, and closes when the biasing force is applied.

Additional advantages and modifications will readily occur to those skilled in the art. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

What is claimed is:

1. An apparatus for electrically coupling an end of a linear conductor to a surface conductor wherein the linear conductor end is disposed along a linear conductor axis and the linear conductor end comprises an inner conductor, the apparatus comprising:

a housing for receiving the linear conductor end, the housing comprising a channel having a channel axis that is non-collinear with respect to the linear conductor axis;

an access contact disposed in the housing, the access contact including: a cavity for receiving the inner conductor of the linear conductor, and an access pin, wherein the access pin is electrically coupled to the inner conductor;

a conductive member movably disposed within the channel of the housing to move along the channel axis, the conductive member having a first end, electrically coupled to the linear conductor end and to the access contact, and a second end to electrically couple the conductive member to the surface conductor, wherein the first end comprises a head; and a biasing member in mechanical communication with the first end of the conductive member to bias the conductive member in electrical contact with the surface conductor;

wherein the access pin is non-collinear with respect to the conductive member.

2. The apparatus of claim 1, wherein the channel axis is substantially perpendicular to the linear conductor axis.

3. The apparatus of claim 1, wherein the conductive member comprises a pin.

4. The apparatus of claim 1, wherein the biasing member is in physical and electrical contact with the conductive member.

5. The apparatus of claim 1, wherein the first end of the conductive member is electrically coupled to the linear conductor end via an intermediate conductor.

6. The apparatus of claim 1, wherein the biasing member comprises a cantilever beam.

7. The apparatus of claim 1, wherein the biasing member comprises a spring.

8. The apparatus of claim 1, wherein the biasing member comprises a resilient plug.

9. The apparatus of claim 1, wherein the biasing member comprises a pneumatic device.

10. The apparatus of claim 1, wherein the biasing member comprises a movable membrane.

11. The apparatus of claim 1, wherein the biasing member comprises a tortioning apparatus.

12. A method for electrically coupling an end of a linear conductor to a surface conductor on a surface component wherein the linear conductor end is disposed along a linear conductor axis, the method comprising: electrically coupling the linear conductor end to a conductive member through an access contact, the access contact including an access pin, the conductive member movably disposed in a housing and disposed non-collinearly with respect to the access pin, the conductive member having a first end electrically coupled to the linear conductor end and a second end to electrically couple the conductive member to the surface conductor, the first end comprising a head; and biasing the conductive member in electrical contact with the surface conductor by applying a bias force to the head of the first end.

13. The method of claim 12, wherein the electrical coupling of the first end of the conductive member to the linear conductor end comprises providing an intermediate conductor.

14. The method of claim 12, wherein the biasing comprises physically and electrically contacting the biasing member with the conductive member.

15. The method of claim 12, wherein the coupling of the linear conductor to the surface conductor comprises using a pin as the conductive member.

16. The method of claim 12, wherein coupling of the linear conductor to the surface conductor comprises providing a head at an end of the pin to electrically couple the linear conductor to the pin.

17. The method of claim 12, wherein biasing comprises using a cantilever beam.

18. The method of claim 12, wherein the biasing comprises using a spring.

19. The method of claim 12, wherein the biasing comprises using a resilient plug.

20. The apparatus of claim 1 wherein the access pin is movable along the linear conductor axis.

21. The apparatus of claim 1 further comprising a socket contact disposed between the access pin and the biasing member, the socket contact having an aperture adapted to receive the access pin, wherein the socket contact electrically couples the access pin to the biasing member.

22. The apparatus of claim 1 wherein the biasing member directly physically contacts the head of the conductive member.

23. The apparatus of claim 1 wherein the biasing member comprises a base and a cantilever beam extending from the base, wherein the cantilever beam directly physically contacts the head of the first end of the conductive member.

24. The apparatus of claim 23 wherein the cantilever beam contacts an apex of the head.

25. The apparatus of claim 1 wherein the access pin directly physically contacts the head of the conductive member.

26. The apparatus of claim 1 wherein the access pin is sandwiched between the biasing member and the head of the conductive member.

27. The apparatus of claim 1 wherein the biasing member is made from a non-conductive material.

28. An apparatus for electrically coupling an end of a linear conductor to a surface conductor wherein the linear conductor end is disposed along a linear conductor axis and the linear conductor end comprises an inner conductor, the apparatus comprising:

a housing for receiving the linear conductor end, the housing comprising a channel having a channel axis that is non-collinear with respect to the linear conductor axis;

an access contact disposed in the housing, the access contact including: a cavity for receiving the inner conductor of the linear conductor, and an access pin, wherein the access pin is electrically coupled to the inner conductor;

a conductive member movably disposed within the channel of the housing to move along the channel axis, the conductive member having a first end, electrically coupled to the linear conductor end and to the access contact, and a second end to electrically couple the conductive member to the surface conductor, wherein the first end comprises a head; and a biasing member in mechanical communication with the first end of the conductive member to bias the conductive member in electrical contact with the surface conductor;

wherein the access pin directly physically contacts the head of the conductive member.

29. An apparatus for electrically coupling an end of a linear conductor to a surface conductor wherein the linear conductor end is disposed along a linear conductor axis and the linear conductor end comprises an inner conductor, the apparatus comprising:

a housing for receiving the linear conductor end, the housing comprising a channel having a channel axis that is non-collinear with respect to the linear conductor axis;

an access contact disposed in the housing, the access contact including: a cavity for receiving the inner conductor of the linear conductor, and an access pin, wherein the access pin is electrically coupled to the inner conductor, a conductive member movably disposed within the channel of the housing to move along the channel axis, the conductive member having a first end, electrically coupled to the linear conductor end and to the access contact, and a second end to electrically couple the conductive member to the surface conductor, wherein the first end comprises a head; and a biasing member in mechanical communication with the first end of the conductive member to bias the conductive member in electrical contact with the surface conductor;

wherein the access pin is sandwiched between the biasing member and the head of the conductive member.

* * * * *